US005440989A

United States Patent [19]

Becker

[11] Patent Number: 5,440,989

[45] Date of Patent: Aug. 15, 1995

[54] METHOD AND DEVICE FOR PERFORMING WORKSTEPS ON A CYLINDER OF A PRINTING PRESS

[75] Inventor: Willi Becker, Bammental, Germany

[73] Assignee: Heidelberger Druckmaschinen AG, Heidelberg, Germany

[21] Appl. No.: 203,278

[22] Filed: Feb. 28, 1994

[30] Foreign Application Priority Data

Feb. 27, 1993 [DE] Germany ..... 43 06 139.7

[51] Int. Cl.[6] ..... B41F 21/00

[52] U.S. Cl. ..... 101/486; 101/415.1

[58] Field of Search ..... 101/415.1, DIG. 36, 101/378, 382.1, 383, 483, 485, 486

[56] References Cited

U.S. PATENT DOCUMENTS

| | | | |
|---|---|---|---|
| 4,596,188 | 6/1986 | Bonomi | 101/415.1 |
| 4,646,639 | 3/1987 | Gollinger et al. | 101/415.1 |
| 4,718,342 | 1/1988 | Raab et al. | 101/409 |
| 4,848,229 | 7/1989 | Grosshauser et al. | 101/415.1 X |
| 4,938,134 | 7/1990 | Dörsam et al. | 101/415.1 |
| 5,259,312 | 11/1993 | Simeth et al. | 101/415.1 |
| 5,339,738 | 8/1994 | Blaser et al. | 101/477 |

FOREIGN PATENT DOCUMENTS

| | | | |
|---|---|---|---|
| 0563601 | 10/1993 | European Pat. Off. . | |
| 4128994 | 7/1992 | Germany | 101/415.1 |
| 4129831 | 7/1992 | Germany | 101/415.1 |
| 4112666 | 10/1992 | Germany | 101/415.1 |

*Primary Examiner*—Chris A. Bennett

*Attorney, Agent, or Firm*—Herbert L. Lerner; Laurence A. Greeenberg

[57] ABSTRACT

Method of performing worksteps in a cylinder of a printing press to which an operating medium is supplied includes energizing with the operating medium at least one actuator for performing the worksteps so that the one actuator acts against operating elements energized by spring force, associating with each of the worksteps a respective defined spring-force energization and a respective pressure stage of the operating medium overcoming the respective spring force, and performing the worksteps in a sequence corresponding to a sequence of association of the pressure stages with the worksteps, in stages towards higher pressures and towards lower pressures, respectively; and device for performing the method.

19 Claims, 5 Drawing Sheets

PRIOR ART 39
37
25
32
31
34
42
21
41
40
20
24
18
17
30
38
29
25
16
23
27
28
19
43
22"
42
35
1
33

METHOD AND DEVICE FOR PERFORMING WORKSTEPS ON A CYLINDER OF A PRINTING PRESS

BACKGROUND OF THE INVENTION

Field of the Invention

The invention relates to a method and a device for performing worksteps on a cylinder of a printing press and, more particularly, while an operating medium is being supplied, the worksteps being performed by at least one actuator energizable by the operating medium and acting against operating elements energized by spring force.

A multiplicity of worksteps are performed on cylinders of a printing press, such as clamping and tensioning of printing plates, correction of the position of printing plates, mounting or locking of coverings or other worksteps. For a long time, such worksteps were performed manually until the trend went in the direction of increasing automation. In the course of this development, actuators were disposed in the cylinders and performed such worksteps when energized with an operating medium. Usually, such actuators act against operating elements energized by spring force. Devices of this type have become known heretofore, for example, from published German Patent Documents DE 41 29 831 A1 and DE 41 28 994 A1. The former document relates to a clamping device for clamping the printing-plate leading edge, and the latter document to a clamping and tensioning device which clamps the rear or trailing edge of a printing plate, the leading edge of which has already been clamped, and then subjects the printing plate to tension.

In the aforementioned devices, it is necessary to provide an actuator, such as a pneumatic cylinder, for example, for each workstep and to energize each of the actuators with an operating medium. It is thus necessary to provide for each actuator a supply of operating medium which has to be brought into the cylinder by means of a rotary lead-through. The rotary lead-throughs for a plurality of operating-medium supply lines are elaborate, expensive and susceptible to fault or failure.

SUMMARY OF THE INVENTION

It is accordingly an object of the invention to provide a method and a device for performing worksteps on a cylinder of a printing press, wherein a plurality of worksteps can be consecutively initiated by means of one operating-medium supply line.

With the foregoing and other objects in view, there is provided, in accordance with the invention, a method of performing worksteps in a cylinder of a printing press to which an operating medium is supplied, which comprises energizing with the operating medium at least one actuator for performing the worksteps so that the one actuator acts against operating elements energized by spring force, associating with each of the worksteps a respective defined spring-force energization and a respective pressure stage of the operating medium overcoming the respective spring force, and performing the worksteps in a sequence corresponding to a sequence of association of the pressure stages with the worksteps, in stages towards higher pressures and towards lower pressures, respectively. Thus, each workstep is associated with a defined spring-force energization and with a pressure stage of the operating medium, the pressure stage overcoming the spring force, and the sequence of association of the pressure stages with the worksteps—in stages towards higher pressures or towards lower pressures—corresponds to the workstep sequence in which the worksteps are to be performed.

Not only does the method according to the invention make it possible to reduce the number of operating-medium supply lines to one single supply line, but in addition, the actuators may be of such construction that one single actuating element or a plurality of simultaneously acting actuating elements can be used to perform various worksteps. This results from the fact that the spring force-energized operating elements are energized with different spring forces on a distance-dependent basis. It is then possible, with each pressure increase to a higher pressure stage, for a workstep to be performed and, with each stagewise reduction in pressure, for the workstep to be reversed in the other direction, such as the tensioning of a printing plate and the untensioning of the printing plate, respectively.

In accordance with another mode, the method according to the invention includes supplying the operating medium in a first and a second pressure stage and, at the first pressure stage, performing a workstep of untensioning a clamped and tensioned printing plate and, at a second and higher pressure stage than the first pressure stage, performing a further workstep of unclamping the printing plate at a trailing edge thereof.

This method according to the invention has the advantage that, in a clamping and tensioning device, for example, such as has become known heretofore from published German Patent Document DE 41 28 994 A1, the unclamping and untensioning of a printing plate can be performed separately, although the clamping and tensioning device is provided with just one actuating element.

In accordance with a mode involving a reverse sequence, the method according to the invention includes reducing the operating medium from the second to the first and lower pressure stage for performing a workstep of clamping the trailing edge of a newly supplied printing plate, and rendering the operating medium pressureless for performing a last workstep of tensioning the printing plate.

It is possible, thereby, to clamp a newly supplied printing plate without simultaneously tensioning the printing plate. The untensioned printing plate is relatively easy to adjust in position on the plate cylinder and, after such adjustment, the printing plate can be tensioned in a further workstep. The advantage of this mode of the method according to the invention, lies in the fact that it is possible in this manner to adjust the position of the printing plate, because, when a printing plate is tensioned, it cannot be positionally adjusted or can be positionally adjusted only with great difficulty. It is also possible to untension a clamped and tensioned printing plate while the clamping is being maintained. This permits positional correction through adjustment of the clamping and tensioning bars without unclamping the printing plate. Devices for correcting the position of a printing plate by adjusting the tensioning bars have become known heretofore from the prior art as exemplified by published German Patent Document DE 39 18 215 C1.

In accordance with an added mode, the method according to the invention includes supplying the operating medium in a third pressure stage and, at the third pressure stage, performing a workstep of unclamping the leading edge of the printing plate. This makes it possible to integrate into the method, by providing the clamping device for clamping the leading edge of the printing plate, clamping of the leading edge of the printing plate, clamping of the trailing edge of the printing plate and tensioning of the printing plate, all of these worksteps being performed in one single operation.

In accordance with an additional mode, the method according to the invention includes reducing the operating medium from the third to the second pressure stage for performing a workstep of clamping the leading edge of the newly supplied printing plate, reducing the operating medium from the second to the first pressure stage for performing a further workstep of clamping the trailing edge of the printing plate, and rendering the operating medium pressureless for performing, in a last workstep, a tensioning of the printing plate. With regard to the integration of the clamping device for the printing-plate leading edge, the method according to the invention provides the following regarding the mounting of a new printing plate: the operating medium is reduced from the third to the second stage so as, in a workstep, to clamp the leading edge of the newly supplied printing plate, thereafter, the operating medium is reduced from the second to the first pressure stage so as, in a further workstep, to clamp the trailing edge of the printing plate, and the operating medium is rendered pressureless so as, in a last workstep, to tension the printing plate. In this manner, also when a new printing plate is supplied, all the worksteps are performed by means of one operating-medium supply line. Initially, the leading edge of the printing plate is clamped; next, the trailing edge of the printing plate is clamped and, if required, the position of the printing plate is adjusted. It is also possible for the printing plate to be tensioned, a specimen print executed, the printing plate untensioned again and the adjustment made, whereafter the printing plate is tensioned again.

A relatively simpler mode of the inventive method without plate adjustment or correction provides that the operating medium be supplied with the second pressure stage so as, in a workstep, to untension a clamped and tensioned printing plate and to unclamp it at the trailing edge thereof and, at the third pressure stage, to unclamp the leading edge of the printing plate in a further workstep.

In a reverse sequence, in accordance with yet another mode, the method according to the invention includes reducing the operating medium from the third to the second pressure stage for performing a workstep of clamping the leading edge of a newly supplied printing plate, and rendering the operating medium pressureless for performing, in a last workstep, a clamping of the trailing edge of the printing plate and a tensioning of the printing plate.

In accordance with another aspect of the invention, there is provided a device for performing worksteps in a cylinder of a printing press having a clamping and tensioning device for a trailing edge of a printing plate, including a tensioning bar and a clamping bar respectively formed with radially extending, oppositely disposed clamping surfaces for gripping an angularly bent-away trailing edge of the printing plate, the tensioning bar being formed as a swivelable double lever swivelable by means of an actuator formed of at least one actuating element against the force of tensioning springs acting in the tensioning direction, the clamping bar being formed as a swivelable double lever connected to the tensioning bar, the clamping surface of the clamping bar being pressable via the double lever by the clamping springs against the corresponding clamping surface of the tensioning bar with a clamping force for holding the printing plate, the clamping bar comprising a holding element cooperating with an adjustable stop so that, when the actuator is operated, the clamping bar is swivelable against the force of the clamping springs, and comprising means for applying pressure to the clamping bar via the actuator in a first pressure stage, the pressure-applying means being dimensioned so that the tensioning springs are compressible by the actuator and, in a second pressure stage, being dimensioned so that the tensioning springs and the clamping springs are compressible by the actuator.

In accordance with another feature of the invention, the device for performing the method according to the invention includes a clamping device for the leading edge of the printing plate, the clamping device including a fixed upper clamping bar and a displaceable lower clamping bar, the displaceable lower clamping bar being bringable into a clamping position and a plate-changing position, the lower clamping bar being pressable into the clamping position by spring elements with the holding force for holding the printing-plate leading edge and being bringable, against the holding force, into the plate-changing position by at least one actuating element, the means for applying pressure to the clamping bar via the actuator being dimensioned in a third pressure stage located above the second pressure stage so that the spring elements are compressible by the actuator.

The invention further provides a device for mounting or locking printing plates on a cylinder which is of such construction that it can perform the method according to the invention. The device of the invention includes a clamping device for clamping the printing-plate leading edge and a clamping and tensioning device for the printing-plate trailing edge. The clamping and tensioning device for the printing-plate trailing edge includes the following parts: a tensioning bar and a clamping bar, the tensioning bar and the clamping bar comprising radially extending, oppositely disposed clamping surfaces for gripping the angularly bent-away trailing edge of the printing plate, the tensioning bar being in the form of a swivelable double lever and being capable of being swiveled, by means of an actuator formed of one or more simultaneously acting actuating elements, against a force of tensioning springs acting in tensioning direction. The clamping bar is in the form of a swivelable double lever connected to the tensioning bar, the double lever, by means of clamping springs, pressing the clamping surface against the corresponding clamping surface of the tensioning bar with a clamping force for holding the printing plate. The clamping bar comprises a holding element cooperating with an adjustable stop in such a manner that, when the actuator is operated, the clamping bar is swivelable against the force of the clamping springs. Such a clamping and tensioning device has become known heretofore from published German Patent Document DE 41 28 994 A1, to which reference may be made with regard to any other possible embodiments. As noted hereinbefore, in accordance with the invention, a clamping and tensioning device of the aforedescribed or comparable type is of such construction that the first pressure stage is dimensioned so that the tensioning springs are compressible by the actuator, and that the second pressure stage is dimensioned so that the tensioning springs and the clamping springs are compressible by the actuator.

Additionally, a clamping device for the printing-plate leading edge may be of such construction that it is operatable by means of the method according to the invention. Such a clamping device may be formed, for example, of a fixed upper clamping bar and a displaceable lower clamping bar, the displaceable lower clamping bar being adapted to be brought into a clamping position and a plate-changing position, with the lower clamping bar being pressed into the clamping position by spring elements with the holding force for holding the printing-plate front edge and being adapted to be brought, against the holding force, into the plate-changing position by at least one actuating element. Such a clamping device for the printing-plate leading edge has become known heretofore from published German Patent Document DE 41 29 831 A1, to which reference may be made with regard to further possible embodiments. According to the invention, the clamping device for the printing-plate leading edge is of such construction that a third pressure stage, lying above the second pressure stage, is dimensioned so that the spring elements are compressible by the actuator.

The method according to the invention can be implemented not only in the aforementioned devices, which have been described merely by way of example. The prior art provides numerous further clamping devices as well as clamping and tensioning devices which are operatable by means of an actuator adapted to be operated against the spring force and which may be of such construction that they can be operated while employing the method according to the invention.

The aforedescribed clamping and tensioning device is operated by means of a pneumatic cylinder or by means of a row of simultaneously acting pneumatic cylinders disposed along the tensioning bar. The clamping device for the printing-plate leading edge is also operated by pneumatic cylinders, it being particularly advantageous for a plurality of simultaneously acting pneumatic cylinders to be disposed along the clamping bar. With regard to the overall mounting device, the actuator is formed of two rows of simultaneously acting pneumatic cylinders. Due to the method according to the invention, it is possible for the actuator to be of such construction that the actuating element of the clamping and tensioning device for the printing-plate trailing edge and the actuating element of the clamping device for the printing-plate leading edge to be provided with a common supply line for energization with the operating medium, for example, with a compressed-air line. Of course, such a device may also be operated hydraulically.

Thus, in accordance with an added feature of the invention, the actuator is formed as an actuating element disposed on the clamping and tensioning device for the printing-plate trailing edge, and as an actuating element disposed on the clamping device for the printing-plate leading edge, as well as a common supply line for energizing with an operating medium.

In accordance with an additional feature of the invention, the device according to the invention includes a plurality of simultaneously acting actuating elements disposed between at least one lever arm of the tensioning bar and at least one lever for displacing the lower clamping bar of the clamping device.

The advantage of this further development of the invention is that both the clamping and tensioning device for the printing-plate trailing edge and also the clamping device for the printing-plate leading edge can be operated with one or more simultaneously acting actuating elements. Consequently, one single actuating element with one single supply line serves to operate the entire plate-mounting device.

In accordance with an additional feature of the invention, the tensioning springs acting on the at least one lever arm are disposed opposite the actuating elements.

In accordance with yet another feature of the invention, at least one adjustable stop for limiting the travel of the lever arms is disposed opposite the actuating elements.

In accordance with a concomitant feature of the invention, the at least one actuating element is a pneumatic cylinder. It is advantageous for the actuating elements to be in the form of pneumatic cylinders, because printing presses use compressed air in any case as an operating medium.

Other features which are considered as characteristic for the invention are set forth in the appended claims.

Although the invention is illustrated and described herein as embodied in a method and a device for performing worksteps on a cylinder of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
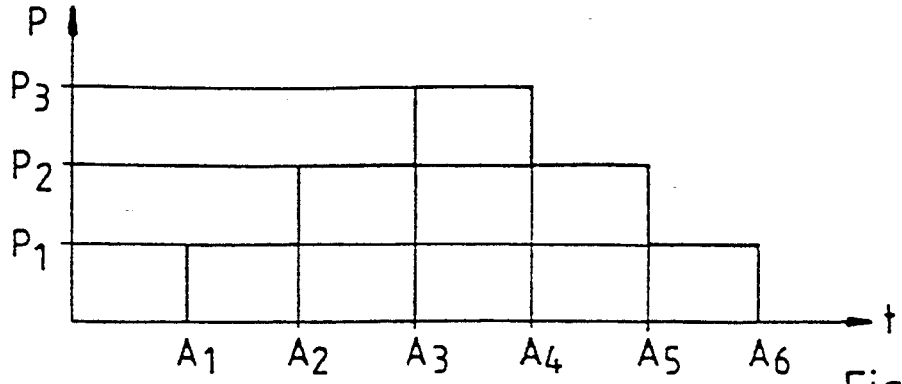
FIG. 1 is a plot diagram of the association of pressure stages with worksteps.

Referring now to the drawing and, first, particularly to FIG. 1 thereof, there is shown therein a plot diagram of the association of pressure stages with worksteps. The pressure of the operating medium is plotted against a time axis. Initially pressureless, the operating medium is energized at a defined point in time with a first pressure stage P1, as a result of which an actuator acts against an operating element energized by spring force and causes a first workstep A1 to be performed. The first workstep may be formed, for example, of the untensioning of a tensioned printing plate. As the pressure is further increased to a second pressure stage P2, a further workstep A2 takes place, because the actuator, energized with a higher pressure, can compress a stronger spring force and thereby move the operating element further. This second workstep A2 is formed, for example, of unclamping the rear or trailing edge of the clamped printing plate. A further pressure increase to the third pressure stage P3 causes the performance of a third workstep A3, which may be formed, for example, of unclamping the front or leading edge of the printing plate.

After this stagewise increase in the pressure, it is possible then to perform worksteps wherein the pressure is again lowered in stages. By lowering the pressure from the third pressure stage P3 to the second pressure stage P2, for example, a workstep A4 may be performed, which calls for clamping a newly supplied printing plate at the front or leading edge thereof. A further lowering of the pressure from the second pressure stage P2 to the first pressure stage P1 results in workstep 5, wherein a printing plate in position on the cylinder, and already clamped at the front or leading edge thereof, is then also clamped at the rear or trailing edge thereof. Finally, the operating medium is rendered pressureless, leading to the performance of a further workstep A6, which may be, for example, tensioning the printing plate which is clamped at the leading and trailing edges thereof. Consequently, the worksteps performed in the course of the stagewise lowering of pressure represent a return to the original position with regard to the worksteps executed in the course of the pressure increase.

Figure 2:
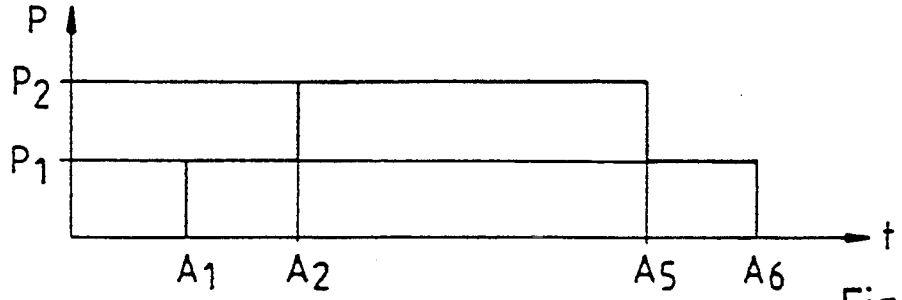
FIG. 2 is a plot diagram similar to that of FIG. 1 but somewhat more simplified.

FIG. 2 shows a simplified diagram for only one clamping and tensioning device, however, for the rear or trailing edge being operated. At a first pressure stage P1, a clamped printing plate is untensioned. In a second workstep A2, due to the increase in pressure from P1 to P2, the rear or trailing edge of the clamped printing plate is unclamped. Correspondingly, worksteps occur wherein the pressure is reduced from P2 to P1. The rear or trailing edge of a newly supplied printing plate is clamped (workstep 5) and, when the actuator is rendered pressureless, the printing plate is tensioned in a workstep A6. In this process, the clamping of the front or leading edge of the printing plate must occur separately.

Figure 3:
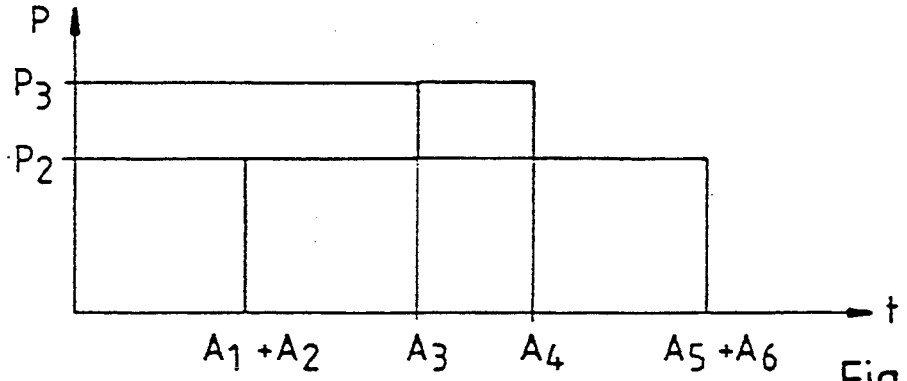
FIG. 3 is a plot diagram similar to those of FIGS. 1 and 2 but even further simplified.

FIG. 3 shows a further simplified diagram, with the pressure being increased immediately to the second pressure stage P2 and with worksteps A1 and A2 being jointly performed. For example, a printing plate is simultaneously untensioned and unclamped at the rear or trailing edge thereof. Worksteps A3 and A4 are performed in the hereinaforedescribed manner.

Thereafter, the pressure, starting from the second pressure stage P2, is released, which results in the simultaneous performance of the worksteps A5 and A6. Thus, a newly supplied printing plate is clamped at the rear or trailing edge thereof and, immediately thereafter, the printing plate is tensioned.

Figure 4:
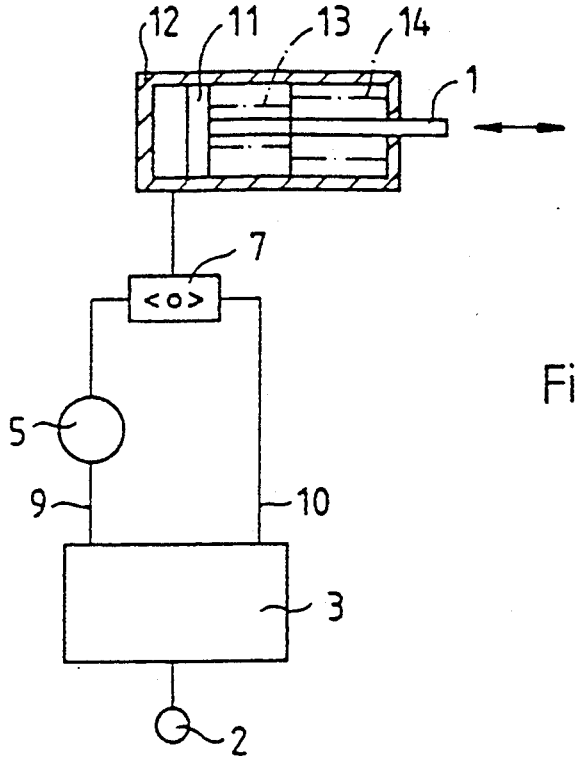
FIG. 4 is a basic circuit diagram of a device for performing the process according to the invention.

FIG. 4 is a circuit diagram depicting the basic operating principle of a device for performing the method according to the invention. The principle is elucidated by noting that, due to energizing an actuator 1 with pressure stages, the actuator 1 traverses or covers different distances and is thus able to perform different worksteps.

The actuator 1 is represented by a piston rod connected to a piston 11 which is displaceable in a pneumatic cylinder 12. When energized with an operating medium, the piston 11 compresses a first spring 13, the piston 11, at the first pressure stage, not yet being in a position to compress a second spring 14. Only by being energized with a higher pressure is the piston 11 able also to compress the second spring 14, thereby covering a further distance resulting in the performance of a second workstep. Energization with pressure is accomplished by connecting an air source 2 to a control valve 3 which is able to apply pressure either to a first output 9 or to a second output 10 or to exhaust the outputs. The first output 9 leads to a pressure regulator 5, which reduces the pressure. Thereafter, the two pressure lines join together in an OR element 7, which supplies the pressure to the pneumatic cylinder 12. The OR element 7 functions in a manner that the respectively higher pressure is permitted to pass through to the pneumatic cylinder 12, a fact which is symbolized by the ball drawn in the OR element 7.

The device according to the invention which is shown in FIG. 4 is capable of causing the performance of four worksteps, the first workstep by energizing with a first pressure which is set by means of the pressure regulator 5. The second workstep is accomplished by connecting the air source 2 directly to the OR element 7. The third workstep is performed by rendering the second output 10 pressureless and, through the intermediary of the pressure regulator 5, the first pressure stage again acts upon the pneumatic cylinder 12. The last or fourth workstep is performed by also rendering the first output 9 of the control valve 3 pressureless. In each of these steps, the actuator 1 covers a defined distance, which results in the performance of the respectively associated workstep.

Figure 5:
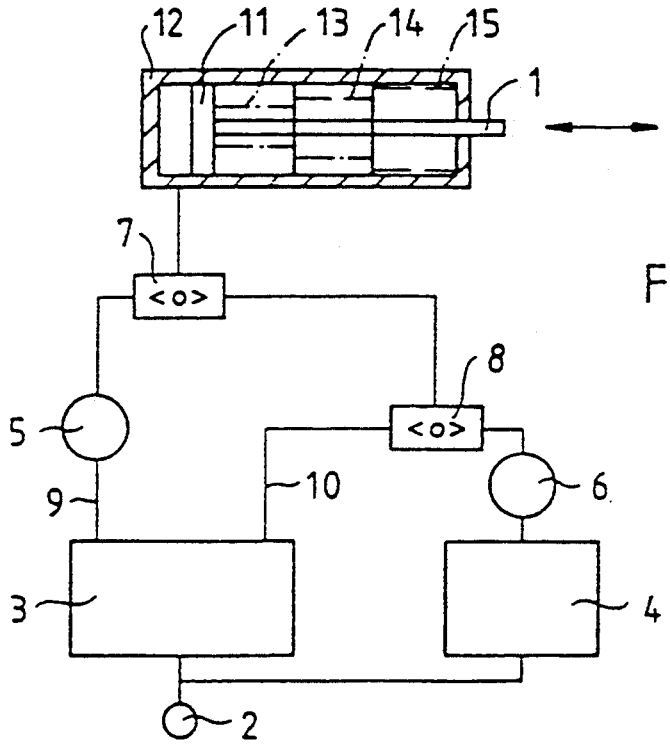
FIG. 5 is a basic circuit diagram of another embodiment of the device according to the invention.

FIG. 5 is a further basic circuit diagram of another embodiment of the device for performing six worksteps. Disposed for this purpose in the pneumatic cylinder 12 is a third spring 15 which exerts a spring force greater than that of the second spring 14, so that, at three different pressure stages, the piston 11 covers three different distances resulting, by means of three pressure increases, in the performance of three worksteps. Three stagewise reductions in pressure lead once again to the performance of three worksteps in the reverse or opposite direction.

Like parts in the pressure regulation device are identified by the same reference characters in FIGS. 4 and 5. In addition, in FIG. 5, the compressed-air source 2 is connected to a further control valve 4, which either passes the compressed air to a further pressure regulator 6 or renders the pressure regulator 6 pressureless. The pressure regulator 6 is connected through the intermediary of a further OR element 8 to the second output 10 of the control valve 3, an output of the OR element 8 leading to an input of the OR element 7, which OR element 7 is, as described hereinbefore, connected to the pneumatic cylinder 12. Essential to the construction of FIG. 5 is that the pressure regulator 5 and the pressure regulator 6 effect two different pressure stages, i.e., they reduce the compressed air from the compressed-air source 2 by different degrees. Thus, for example, a first pressure stage may be performed by energizing the first output 9 with pressure through the intermediary of the pressure regulator 5, a first pressure stage being passed on in this manner to the pneumatic cylinder 12. A second pressure stage is established by providing that, through the intermediary of the pressure regulator 6, the further control valve 4 makes available a second and higher pressure stage which reaches the pneumatic cylinder 12 via the OR elements 8 and 7. The third pressure stage is established by providing that the second output 10 be connected directly to the compressed air from the compressed-air source 2, the compressed air therefore being passed on to the piston 11 through the OR elements 7 and 8.

The pressure is lowered in a corresponding manner in that the second output 10 is rendered pressureless, the pressure energization therefore being accomplished through the intermediary of the pressure regulator 6. When the further control valve 4 exhausts, the first pressure stage passes via the pressure regulator 5 to the pneumatic cylinder 12, whereafter a further lowering of the pressure can be effected by a complete exhaustion. According to these pressure stages, the piston 11, as described hereinbefore, covers the distances which result in the performance of the various worksteps.

Figure 6:
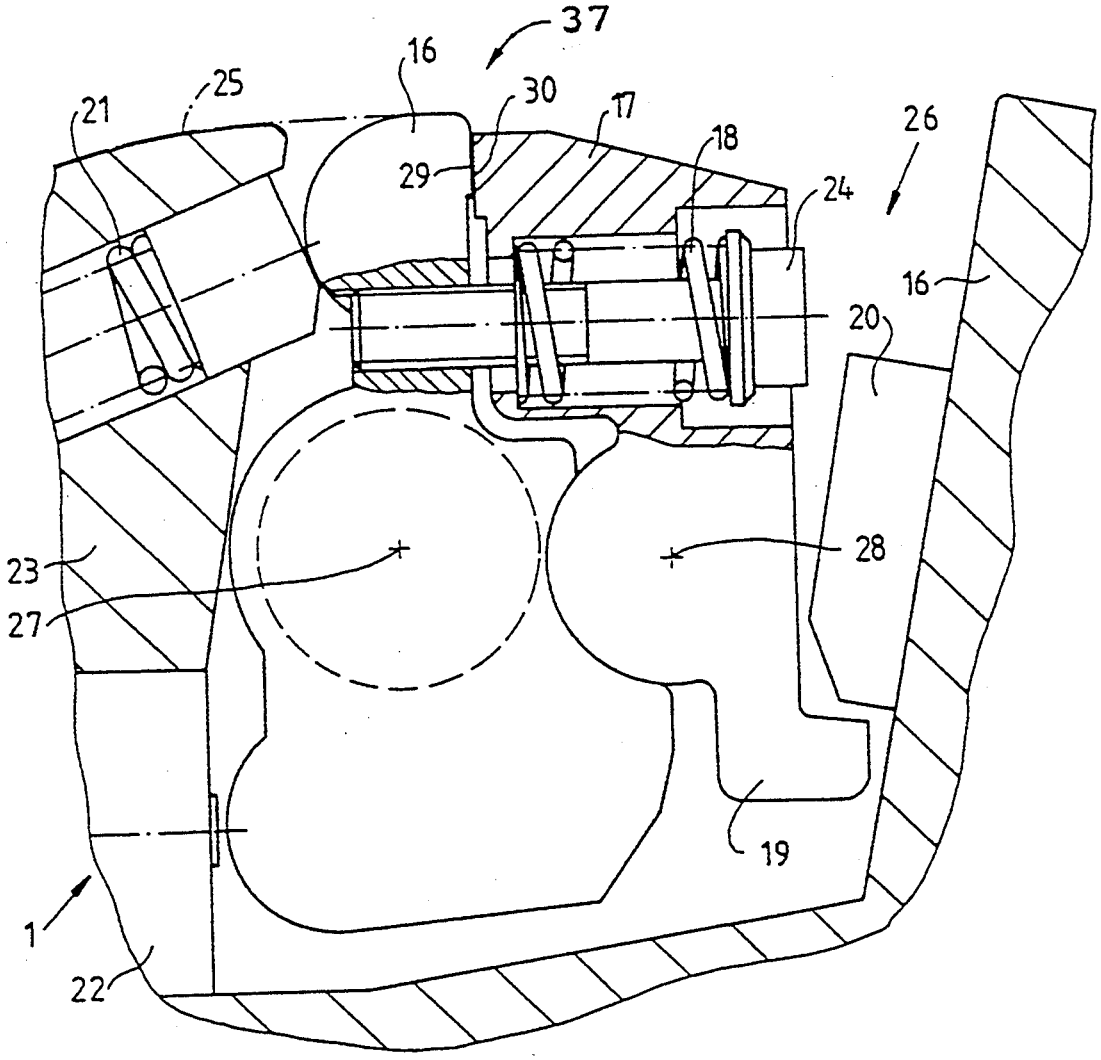
FIG. 6 is a fragmentary cross-sectional view of a plate cylinder of a printing press showing a prior-art clamping and tensioning device for the rear or trailing edge of a printing plate.

FIG. 6 shows a clamping and tensioning device for the trailing edge of the printing plate, which is operatable for performing the method according to the invention. The clamping and tensioning device has become known heretofore, for example, from published German Patent Document DE 41 28 994 A1, to which reference may be made with regard to further embodiments of the device.

The construction of the clamping and tensioning device is as follows:

The cylinder 23 is furnished with a cylinder gap 26 wherein the clamping and tensioning device 37 is disposed. A tensioning bar 16 is held in the cylinder 23 by means of a rotatable mounting 27. The tensioning bar 16 is formed at a front end thereof with a clamping surface 29 which cooperates with a clamping surface 30 of a clamping bar 17. The clamping bar 17 likewise has a rotatable mounting 28 which is situated on the tensioning bar 16. Both the tensioning bar 16 and also the clamping bar 17 are each furnished, with reference to the rotatable mountings 27 and 28, with a lever directed into the interior of the cylinder. The inwardly directed lever of the tensioning bar 16 cooperates with at least one actuating element 22, which serves to swivel the clamping and tensioning device 37. The actuating element 22 swivels the tensioning bar 16 opposite to the tensioning direction for the printing plate 25, as a result of which the printing plate 25 is untensioned. Tensioning springs 21, disposed in the front region of the clamping bar 17, serve to tension the printing plate 25. Clamping is accomplished by means of clamping springs 18, which are disposed in the front region of the clamping bar 17 and which are situated between the clamping bar 17 and the heads of clamping-spring screws 24 which penetrate the clamping bar 17 and are screwed into the tensioning bar 16. The clamping force is released by means of a holding element 19, which cooperates with a fixed stop 20 due to the swivelling of the bars 16 and 17 by means of the actuating element 22.

The operating principle thereof is as follows:

Through the operation of one or more actuating elements 22, the tensioning bar 16 swivels against the spring force of the tensioning springs 21 and, in the course of the swivelling motion, initially, a clamped printing plate 25 is untensioned and, then, the holding element 19 strikes against the fixed stop 20, as a result of which the clamping springs 18 are compressed and the tensioning device opens. If a printing plate were clamped, it may then be removed from the clamping and tensioning device.

The angularly bent-away end of a new printing plate 25 can then be inserted between the clamping surfaces 29 and 30, whereafter the actuating element 22 is pulled back, as a result of which the tensioning springs 21 cause a swivelling motion in the plate-tensioning direction. When the clamping surfaces 29 and 30 engage one another, the holding element 19 moves away from the fixed stop 20, as a result of which the clamping springs 18 press the clamping bar 17 against the tensioning bar 16, clamping the end of the printing plate 25. After the printing plate 25 has been clamped, a further backward motion of the actuating element 22 causes the printing plate 25 to be subjected to tension with the aid of the tensioning springs 21.

In order to operate by the method according to the invention, the clamping and tensioning device is constructed so that the first pressure stage P1 is of such dimensions that the tensioning springs 21 are compressible by the actuating element 22. The second pressure stage P2 is dimensioned so that the actuating element 22 swivels the tensioning bar 16 with such a force that both the tensioning springs 21 and also the clamping springs 18 are compressed. In this manner, the operations of clamping the printing-plate rear or trailing edge and of tensioning the printing plate are separate from one another. It is possible, thereby, to clamp the printing-plate rear or trailing edge without, however, at this stage, tensioning the printing plate, thereby permitting the position of the printing plate to be adjusted. This is achieved notwithstanding that only one actuating element or one row of simultaneously acting actuating elements 22 is provided and although control is effected by means of one operating-medium supply line. Conversely, also when the printing plate is being removed, the release of the plate tension and the unclamping of the end of the printing plate are separate operations. The method according to the invention also makes it possible once again to untension a tensioned printing plate the incorrect position of which becomes apparent during printing, to adjust the position and thereafter again to tension the printing plate in order to continue printing in correct register. In conjunction with automatic printing-plate swivelling, for example, for diagonal-register adjustment, it is possible to implement automatic adjustment or correction.

Figure 7:
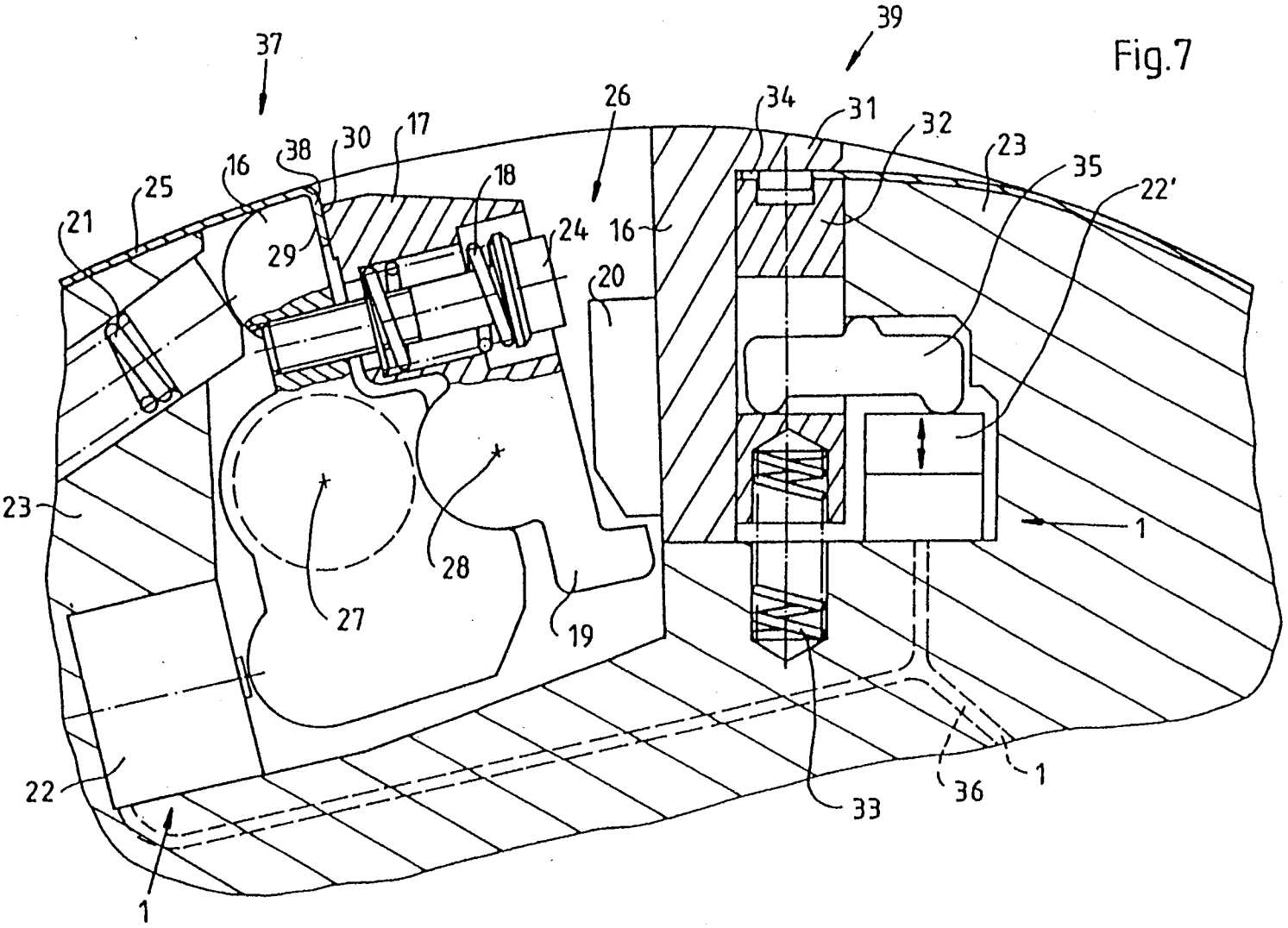
FIG. 7 is a slightly reduced view like that of FIG. 6 but further including a device according to the invention for mounting or locking the printing plate on the printing-press cylinder.

FIG. 7 shows a device for mounting or locking a printing plate on the cylinder of a printing press, the clamping and tensioning device being of the same construction described hereinbefore with reference to FIG. 6. In addition, this embodiment of the device comprises a clamping device for the front or leading edge 39 of the printing plate. The device is formed of a fixed upper clamping bar 31 and a displaceable lower clamping bar 32, the displaceable lower clamping bar 32 being adapted to be brought into a clamping position and into a plate-changing position. Spring elements 33 apply a spring force to the lower clamping bar 32, the spring force being equivalent to the holding force for holding the printing-plate front or leading edge 34. The lower clamping bar 32 is pressed into the clamping position thereof by the spring elements 33. At least one actuating element 22', and preferably a row of simultaneously acting actuating elements 22', are disposed in such a manner that they are able, by means of the lever 35, to bring the lower clamping bar 32, against the spring force of the spring elements 33, into the plate-changing position.

According to the invention, the device for mounting printing plates is constructed in such a manner that, apart from the dimensioning of pressure stages and spring forces, as was described hereinbefore with regard to FIG. 6, a third pressure stage P3 is additionally provided. The pressure stage P3 has a higher pressure than the pressure stage P2 and is dimensioned so that the spring elements 33 for clamping the front or leading edge of the printing plate 34 are compressible by means of the actuating elements 22'.

To make do with one operating-medium supply, the line for the operating medium 36 divides and leads both to the actuating element 22 and also to the actuating element 22'. Consequently, the actuator 1 is formed of actuating elements for the clamping and tensioning device 37 and of actuating elements for the clamping device 39, a common supply line being in existence and the various worksteps being performable by means of the pressure stages P1 to P3.

Figure 8:
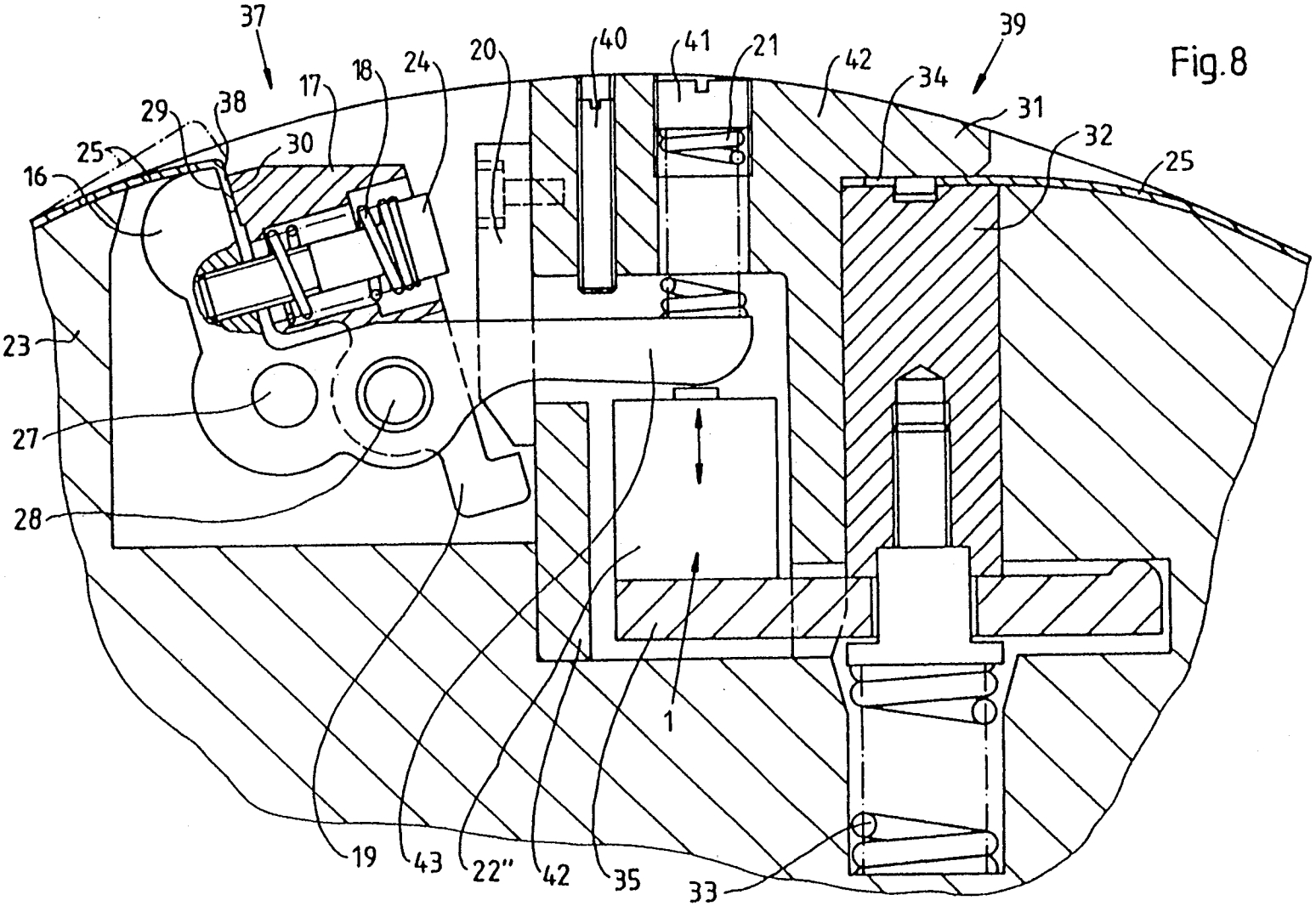
FIG. 8 is a view like that of FIG. 7 of another embodiment of the plate-locking device.

FIG. 8 illustrates an improved embodiment of the device according to FIG. 7, with one or more simultaneously acting actuating elements 22" being disposed between at least one lever arm 43 of the tensioning bar 16 and at least one lever 35 for displacement of the lower clamping bar 32 of the clamping device 39. As can be seen from FIG. 8, the lever arm 43 has been angularly bent-away with respect to the front end of the tensioning bar 16, so that it extends in the direction of the clamping bar 32 for clamping the printing-plate front or leading edge. The lever 35 is supported at one end thereof on the cylinder 23, the actuating element 22" being disposed at the other end of the lever 35. In a central region thereof, the lever 35 penetrates the displaceable lower clamping bar 32 or is attached thereto by means of screws, at any rate being so connected thereto that the lever 35 engages the displaceable lower clamping bar 32 and is able to move it against the spring force of the spring elements 33 towards the center of the cylinder.

In the clamping and tensioning device 37 for the printing-plate rear or trailing edge, the tensioning springs 21 are disposed opposite the actuating elements 22' so that they act upon the lever arms 43. Disposed along the tensioning bar 16 are the same number of lever arms 43, actuating elements 22" and tensioning springs 21, respectively, operatively interconnected. The tensioning springs 21 are held by screws 41. By means of the screws 41 it is also possible to adjust the preloading of the tensioning springs 21. At least one adjustable stop 40 may be attached in the swivelling path of at least one lever arm 43, opposite the actuating elements 22", the adjustable stop 40 serving to limit the travel of the lever arms 43. When the lever arm 43 strikes against the stop 40, the operation of the clamping and tensioning device 37 is terminated and any further increase in the pressure of the operating medium leads, starting from a given compressive force, to the opening of the clamping device 39.

This further development of the invention has the advantage that, with one single row of simultaneously acting actuating elements 22", it is possible to execute six operations: namely, the clamping of the printing-plate front or leading edge; the clamping of the printing-plate rear or trailing edge; the tensioning of the printing plate; the untensioning of the printing plate; the unclamping of the printing-plate rear or trailing edge; and the unclamping of the printing-plate front or leading edge. One single operating-medium supply line is required for all worksteps and all worksteps can be performed by means of the one simultaneously acting row of actuating elements 22", the pressure stages and spring forces, taking into account the lever arms, corresponding to those described hereinbefore.

I claim:

1. In a method of performing worksteps at a cylinder of a printing press of the type having at least one actuator to which an operating medium is supplied through a supply line, and an operating element disposed at the cylinder and acted upon by a given spring force, the actuator being actuatable against the operating element counter the given spring force, the improvement which comprises:

energizing with the operating medium at least one actuator so that the at least one actuator acts against an operating element counter a spring force acting thereon, supplying the operating medium under discretely defined pressure stages, associating with each workstep to be performed with the operating element in the energizing step a respective defined spring force acting on the operating element and a respective pressure stage of the operating medium overcoming the respective spring force, and performing successive worksteps in a sequence corresponding to increasing and decreasing pressures, respectively, of the operating medium acting on the actuator.

2. Method according to claim 1, which includes supplying the operating medium in a first and a second pressure stage and, at the first pressure stage, performing a workstep of untensioning a clamped and tensioned printing plate and, at a second and higher pressure stage than the first pressure stage, performing a further workstep of unclamping the printing plate at a trailing edge thereof.

3. Method according to claim 2, which includes reducing the operating medium from the second to the first pressure stage for performing a workstep of clamping the trailing edge of a newly supplied printing plate, and rendering the operating medium pressureless for performing a last workstep of tensioning the printing plate.

4. Method according to claim 2, which includes supplying the operating medium in a third pressure stage and, at the third pressure stage, performing a workstep of unclamping the leading edge of the printing plate.

5. Method according to claim 4, which includes reducing the operating medium from the third to the second pressure stage for performing a workstep of clamping the leading edge of the newly supplied printing plate, reducing the operating medium from the second to the first pressure stage for performing a further workstep of clamping the trailing edge of the printing plate, and rendering the operating medium pressureless for performing, in a last workstep, a tensioning of the printing plate.

6. Method according to claim 2, which includes supplying the operating medium with the second pressure stage for performing, in a workstep, an untensioning of a clamped and tensioned printing plate and an unclamping of the printing plate at a trailing edge thereof and, at a third pressure stage, performing a further workstep of unclamping the leading edge of the printing plate.

7. Method according to claim 6, which includes reducing the operating medium from the third to the second pressure stage for performing a workstep of clamping the leading edge of a newly supplied printing plate, and rendering the operating medium pressureless for performing, in a last workstep, a clamping of the trailing edge of the printing plate and a tensioning of the printing plate.

8. In combination with a printing press, said printing press having a cylinder with a clamping and tensioning device for a trailing edge of a printing plate, a tensioning bar and a clamping bar respectively formed with radially extending, oppositely disposed clamping surfaces for gripping an angularly bent-away trailing edge of the printing plate, tensioning springs acting on the tensioning bar with a given spring force in a tensioning direction, and clamping springs acting on the clamping bar, an actuator formed of at least one actuating element acting counter the given spring force of the tensioning springs and counter the clamping springs, the tensioning bar being formed as a swivelable double lever swivelable by means of the actuator against the force of the tensioning springs acting in the tensioning direction, the clamping bar being formed as a swivellable double lever connected to the tensioning bar, the clamping surface of the clamping bar being pressable via the double lever by the clamping springs against the corresponding clamping surface of the tensioning bar with a clamping force for holding the printing plate, the clamping bar being swivelable against the force of the clamping springs by the actuator, a device for performing worksteps at the cylinder of the printing press, comprising means for applying pressure to the clamping bar via the actuator in a first pressure stage and in a second pressure stage, and means defining said first pressure stage such that the tensioning springs are compressible by the actuator and defining said second pressure stage such that both the tensioning springs and the clamping springs are compressible by the actuator.

9. Device according to claim 8, including a clamping device for the leading edge of the printing plate, said clamping device including a fixed upper clamping bar and a displaceable lower clamping bar, said displaceable lower clamping bar being moveable into a clamping position and a plate-changing position, spring elements acting on said lower clamping bar, said lower clamping bar being pressable into the clamping position by said spring elements with the holding force for holding the printing-plate leading edge and being moveable, against said holding force, into the plate-changing position by said at least one actuating element, said means for applying pressure to the clamping bar via the actuator applying pressure in a third pressure stage defined with a higher pressure than the second pressure stage, said third pressure stage being defined for compressing said spring elements with the actuator.

10. Device according to claim 9, wherein the actuator is formed as an actuating element disposed on the clamping and tensioning device for the printing-plate trailing edge, and as an actuating element disposed on the clamping device for the printing-plate leading edge, as well as a common supply line for energizing with an operating medium.

11. Device according to claim 9, including at least one lever arm of the tensioning bar and at least one lever for displacing the lower clamping bar, and a plurality of simultaneously acting actuating elements disposed between said at least one lever arm of the tensioning bar and said at least one lever for displacing the lower clamping bar of the clamping device.

12. Device according to claim 11, wherein said tensioning springs acting on the at least one lever arm are disposed opposite said actuating elements.

13. Device according to claim 11, wherein at least one adjustable stop for limiting the travel of the lever arms is disposed opposite said actuating elements.

14. Device according to claim 8, wherein said at least one actuating element is a pneumatic cylinder.

15. In a printing press having print unit cylinders, at least one supply line for conducting an operating medium to the cylinder, at least one actuator communicating with the at least one supply line and receiving the operating medium, an operating element disposed at the cylinder and acted upon by a given spring force, the actuator acting against the operating element counter the given spring force, a device for performing worksteps at the cylinder of the printing press with the operating element, the device comprising:

means for supplying the operating medium under defined pressure stages; and means for associating with each workstep to be successively performed with the operating element a respective defined spring-force and a respective pressure stage of the operating medium overcoming the respective spring force acting against the operating element, said means associating respective pressure stages with pressures increasing or decreasing with each successive workstep to be sequentially performed with the operating element.

16. The device according to claim 15, wherein the cylinder of the printing press includes means actuated with the operating element for clamping thereon a printing plate with a leading edge and a trailing edge, and the device further comprises means for selectively supplying the operating medium at a first and at a second pressure stage, said associating means associating the first pressure stage with untensioning a clamped and tensioned printing plate and the second pressure stage with unclamping the trailing edge of the printing plate from the cylinder.

17. The device according to claim 16, wherein said selectively supplying means reduce the pressure of the operating medium from the second to the first pressure stage for clamping a trailing edge of a newly supplied printing plate, and subsequently reduce the pressure below the first pressure stage for tensioning the printing plate in a further workstep.

18. The device according to claim 16, wherein said selectively supplying means further supply the operating medium at a third pressure stage for unclamping the leading edge of the printing plate.

19. The device according to claim 18, wherein said means reduces the pressure of the operating medium from the third to the second pressure stage for clamping the leading edge of the newly supplied printing plate, reducing the operating medium from the second to the first pressure stage for performing a further workstep of clamping the trailing edge of the printing plate, and rendering the operating medium pressureless for performing, in a last workstep, a tensioning of the printing plate.

* * * * *